US005627505A

United States Patent [19]

Iwaszek

[11] Patent Number: 5,627,505

[45] Date of Patent: May 6, 1997

[54] MAGNETIC CYLINDER WITH AXIAL EXTENDING PERMANENT BAR MAGNETS

[75] Inventor: Thaddeus T. Iwaszek, St. Paul, Minn.

[73] Assignee: T. D. Wright, Inc., St. Paul, Minn.

[21] Appl. No.: 674,254

[22] Filed: Jul. 1, 1996

[51] Int. Cl.[6] ..... H01F 7/02; B41F 27/02

[52] U.S. Cl. ..... 335/302; 101/389.1

[58] Field of Search ..... 335/209, 285, 335/288, 296, 301, 302; 101/378, 389.1

[56] References Cited

U.S. PATENT DOCUMENTS

| | | | |
|---|---|---|---|
| 3,610,583 | 10/1971 | Ostrom et al. | 254/150 |
| 3,721,189 | 3/1973 | Bray | 101/389.1 |
| 3,824,926 | 7/1974 | Fukuyama | 101/378 |
| 4,114,532 | 9/1978 | Arzoumanian | 101/93.48 |
| 4,625,928 | 12/1986 | Peekna | 242/7.02 |
| 4,676,161 | 6/1987 | Peekna | 101/378 |
| 4,852,490 | 8/1989 | McEachern | 101/378 |
| 5,219,050 | 6/1993 | Kubomiya | 188/267 |

*Primary Examiner*—Edward Tso
*Assistant Examiner*—Adolf Berhane
*Attorney, Agent, or Firm*—Jacobson and Johnson

[57] ABSTRACT

A magnetic cylinder for holding printing plates and the like having a drum of non-magnetic material with recesses on the drum surface containing a series of uninterrupted elongated permanent ceramic magnets extending substantially the length of the cylinder in an axial direction with pole pieces between adjacent magnets.

5 Claims, 1 Drawing Sheet

MAGNETIC CYLINDER WITH AXIAL EXTENDING PERMANENT BAR MAGNETS

FIELD OF THE INVENTION

This invention is to provide a curved magnetic latch or holding device specifically in the from of a magnetic cylinder (or a section of a magnetic cylinder) for use in holding printing plates or the like.

DESCRIPTION OF THE PRIOR ART

There are a large number of magnetic cylinders for use for the same purpose as the instant device. These devices utilize magnets which are generally polarized in an axial direction and are separated axially from one another with pole pieces between the magnets. The resulting magnetic field between the pole pieces extends radially to magnetically hold the printing plate or similar device in place during the operation of the cylinder. Typical examples of these prior art devices are shown in U.S. Pat. No. 3,810,055 by Wright; U.S. Pat. No. 3,824,926 by Fukuyama; and U.S. Pat. No. 3,721,189 by Bray.

In U.S. Pat. No. 3,217,645 by Martt a flexible printing plate is held in place on a drum by mechanical clamps but the end edges of the plates are held in place by a elongated U-shaped magnet extending in an axial direction across the drum.

U.S. Pat. No. 2,788,743 to Schwerin illustrates a drum for magnetically holding plates for photogravure and similar printing. The patent illustrates use of an electromagnets with oppositely polarized magnets running across the length of the drum parallel to one another. The polarization of the extending legs of the electromagnet appears to be either circumferentially, with the lines of force of magnetic leakage traveling in the space between adjacent arms of the electromagnet, or extending in an axial direction out the outer ends of the legs of the electromagnet. The Schwerin patent does not illustrate radially polarized pole pieces between circumferentially polarized magnets to provide a magnetic field of the nature provided by the invention of the present application to securely hold a printing plate or the like in place during rapid travel of a printing cylinder.

SUMMARY OF THE INVENTION

A series of ceramic permanent bar magnets are placed parallel to one another lengthwise to extend in an axial direction across the length of the drum of non-magnetic material at the outer surface of the drum with pole pieces between and in contact with adjacent magnets. The pole pieces are polarized by the magnets to provide a uniform radially extending magnetic field across the entire length of the cylinder of suffficent strength at the circumference or outer surface of the dram to hold a printing plate, or the like, securely in place during the rapid rotation of the magnetic cylinder. Preferably the magnets are rectangular and rest in rectangular-shaped pockets or recesses formed in the drum. As a result, the drum is simple construct, has a reduced number of pieces and therefore can be made at a lower cost. Furthermore, a greater magnetic holding area is provided. Also, no protective covering over the magnets is needed thereby increasing the efficiency of the cylinder.

DESCRIPTION OF THE PREFERRED EMBODIMENTS

Figure 1:
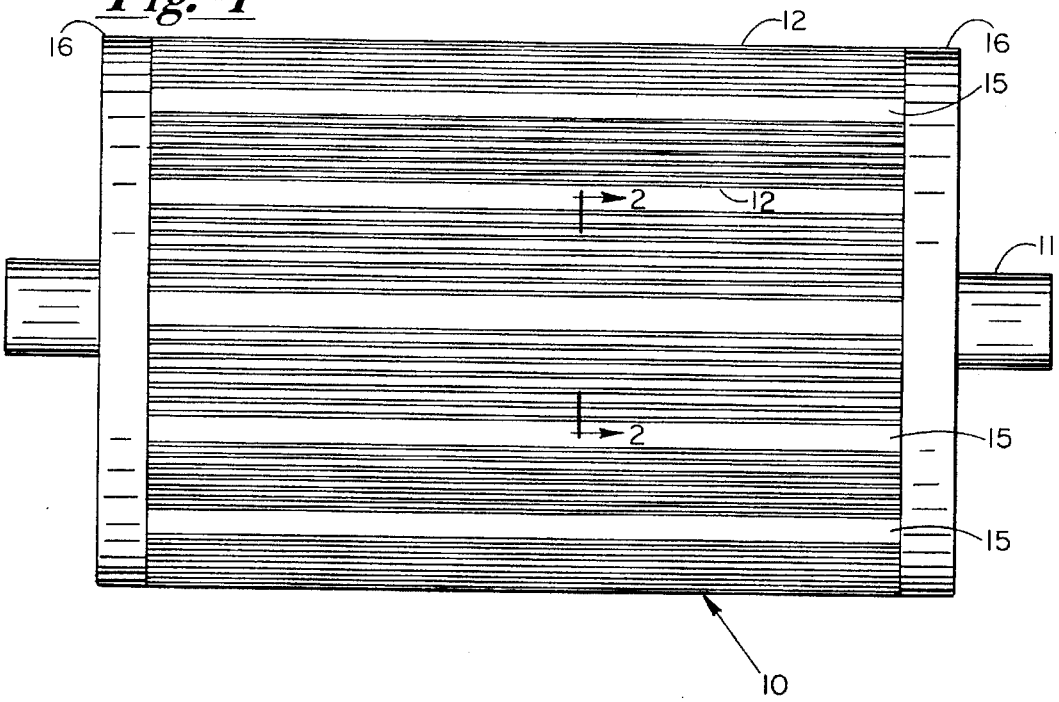
FIG. 1 is a general plan view of a preferred embodiment of the invention.
Figure 2:
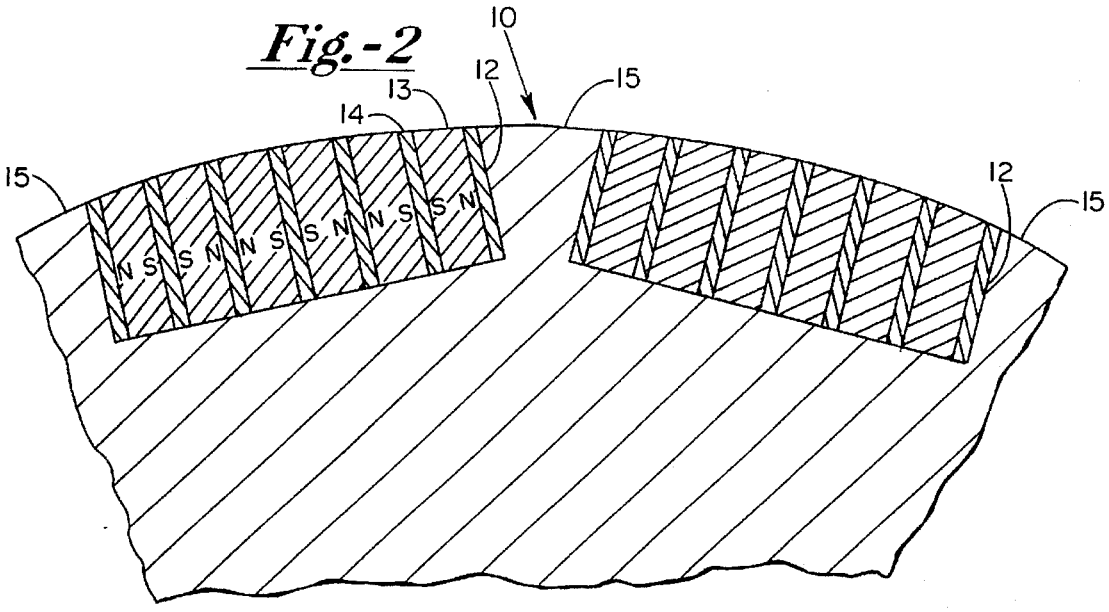
FIG. 2 is an enlarged section view illustrating the placement and location of the stack of magnetic elements.

A cylindrical drum is made of a cylinder of non-magnetic material 10 and has a conventional axial shaft 11. Alternatively, the drum may be made of steel but with a suitable magnetic insulator. The drum might be hollowed out if desired for weight reduction provided that the removal of material doesn't reduce the strength of the drum for its use in the printing process. A series of recesses or pockets 12 are formed, preferably by machining, on the outer surface of drum 10. Recesses 12 extend over the substantial axial length of the drum. Also, usually recesses 12 are formed over the entire circumference of the drum but in the event that only half or a section of the drum is intended to be used, for example when providing merely a semicylindrical saddle for a printing plate, then recesses 12 would be formed over only about one-half of the drum. Firmly resting in each of the recesses 12 is a stack of magnetic elements. The stack comprises a number of elongated hard ceramic permanent bar magnets 13 separated circumferentially from one another by a pole piece 14 between each successive magnet in a stack in close intimate contact with the adjacent magnets. Bar magnets 13 are magnetized in a general circumferential direction with successive magnets being oppositely polarized. As illustrated most clearly in FIG. 2, starting at one side of a recess or pocket 12 and going clockwise, a first pole piece 14 has an adjacent first magnet 13 polarized or oriented N-S, then another pole piece with the next magnet polarized or magnetically oriented S-N followed by another pole piece and then another N-S oriented magnet, et seq. This then forms alternate North and South magnetic pole pieces to provide the magnetic field for holding a printing plate (not shown) when the cylinder is in use. Preferably magnets 13 are made out of a commercially available ceramic grade 8 magnet material. Drum 10 may be made out of some suitable non-magnetic rigid material such a carbon fiber or aluminum. Pole pieces 14 are made for example out of a 400 series stainless steel or mild steel material. Preferably an adhesive is used to hold the pole pieces and magnets in place in the recesses. A suitable adhesive that can be used for this purpose is an expoxy resin such as the commercial product known as Fuller's Resiweld FE-7004. In addition, pole pieces 14 are locked in place by end cap rings 16. In some cases the end cap rings also help hold magnets 13 in place. In the assembly process, a stack of magnetic elements comprising magnets and pole pieces is inserted in the respective pockets or recesses 12 and then the outer periphery of the drum is machined down to eliminate any protruding edges so that the outer surface of the drum then is uniform and smooth. Because magnets 13 are made out of ceramic type material so that they are very hard, no outer layer is needed to predict the magnets from the forces which they encounter in the rapid spinning of the cylinder when in use. As a result, a more efficient and stronger magnetic field is applied to hold the printing plate (or other device) in place. The circumferentially polarized magnets magnetize the adjacent pole pieces so that successive pole pieces are of opposite polarity. The magnetic path is completed with the magnetic field exiting generally radially from one pole piece through the printing plate or die plate to the next pole piece.

Preferably pockets or recesses 12 are rectangular and correspondingly magnets 13 and pole pieces 14 are also rectangular. As a result, there are small gaps or separations or ledges 15 between recesses 12 around the outer surface of the drum.

It may be possible that the pockets or recesses 12 could be made slightly tapered at their sides to minimize the number and the size of the separation areas 15 over the outer surface of the drum. This would require that magnets 13 and pole pieces 14 also be made somewhat tapered in shape in order to fit together uniformly and snugly in recesses 12.

Typically with no limitation thereto being intended, a five inch (diameter) cylinder may have a series of eighteen pockets or recesses 12 each about 0.720" wide and having a depth of about a quarter of an inch. The axial length may be in the order of about six and five-eighths inches. The magnets arc rectangular having a length of about six and five-eighths inches, thickness (in the magnetized or polarized direction) of about 0.080 inch and height (radially) of about one-quarter inch. The pole pieces have the same dimensions except that their thickness is about 0.032 inch. As a result, a stack of magnetic elements in a recess in a cylinder of this dimension would include seven pole pieces and six magnets so that each pocket or recess has about 9.7 poles per inch (ppi).

For certain applications it may be desirable to have a greater ppi or in some cases a lesser ppi may be acceptable. Each case may be determined by an analysis of the dimensions, the magnet holding strength, the magnet size (and probably other factors) to obtain an optimum ppi for the application. There appears to be computer software which will enable a designer to ascertain the optimum ppi for a given application. Also, there may be pragmatic considerations to be taken into account such as, for example, the cost of the magnets, the ease of manufacture of the cylinder and the cylinder durability for the given application.

I claim:

1. A cylinder for magnetically holding a printing plate, comprising:

a) a suitably magnetically insulated cylindrical drum, and b) a plurality of elongated permanent ceramic bar magnets, each of said magnets extending uninterrupted substantially across the axial length of the drum, said magnets arranged substantially parallel to one another at the outer surface of said drum with a pole piece between and in intimate contact with each magnet, the magnets being magnetically oriented such that each successive pole piece is oppositely polarized.

2. The magnetic cylinder as described in claim 1 wherein said magnets and associated pole pieces rest in a series of recesses formed at the outer surface of said drum.

3. The magnetic cylinder as described in claim 2 wherein said magnets and said pole pieces and said recesses are rectangular, with the outer edges of the magnets and pole pieces rounded off to from a continuous smooth outer cylindrical surface.

4. A cylinder for magnetically holding a printing plate or the like, comprising:

a suitably magnetically insulated cylindrical drum;

a plurality of recesses at the outer surface of said drum, said recesses extending uninterrupted over substantially the entire length of said drum in the axial direction;

a stack of magnetic elements filling each of said recessses;

said stack of magnetic elements consisting of multiple permanent ceramic bar magnets with the magnets being magnetically oriented so that successive magnets have the same pole facing one another; and a pole piece in close contact with but separating each of said magnets.

5. The magnetic cylinder as described in claim 4 wherein said recesses, said magnets and said pole pieces are rectangular.

* * * * *